US009725992B2

(12) United States Patent
Watson et al.

(10) Patent No.: US 9,725,992 B2
(45) Date of Patent: Aug. 8, 2017

(54) ENTRY GUIDE FORMATION ON A WELL LINER HANGER

(75) Inventors: Brock W. Watson, Carrollton, TX (US); Daniel K. Moeller, Wassenaar (NL)

(73) Assignee: Halliburton Energy Services, Inc., Houston, TX (US)

( * ) Notice: Subject to any disclaimer, the term of this patent is extended or adjusted under 35 U.S.C. 154(b) by 560 days.

(21) Appl. No.: 12/954,258

(22) Filed: Nov. 24, 2010

(65) Prior Publication Data

US 2012/0125635 A1 May 24, 2012

(51) Int. Cl.
*E21B 43/10* (2006.01)
*E21B 29/00* (2006.01)

(52) U.S. Cl.
CPC ..... *E21B 43/103* (2013.01); *E21B 29/00* (2013.01)

(58) Field of Classification Search
CPC ..... E21B 29/10; E21B 29/00; E21B 29/002; E21B 43/106; E21B 43/103
USPC ..... 166/378, 380, 381, 206, 208
See application file for complete search history.

(56) References Cited

U.S. PATENT DOCUMENTS

| | | | | |
|---|---|---|---|---|
| 2,259,232 | A | 10/1941 | Stone | |
| 2,342,930 | A | 2/1944 | Fortune | |
| 2,737,247 | A * | 3/1956 | Baker et al. | 166/203 |
| 3,077,933 | A | 2/1963 | Bigelow | |
| 3,219,116 | A | 11/1965 | Matthews, Jr. | |
| 3,871,449 | A | 3/1975 | Ahlstone | |
| 4,251,176 | A | 2/1981 | Sizer et al. | |
| 4,388,971 | A | 6/1983 | Peterson | |
| 4,391,325 | A | 7/1983 | Baker et al. | |
| 4,449,281 | A * | 5/1984 | Yoshida et al. | 29/421.1 |
| 4,681,168 | A | 7/1987 | Kisling, III | |
| 4,848,469 | A | 7/1989 | Baugh et al. | |
| 4,877,356 | A * | 10/1989 | Bontenbal | 405/169 |
| 4,911,237 | A | 3/1990 | Melenyzer | |
| 4,926,936 | A | 5/1990 | Braddick | |
| 5,070,941 | A | 12/1991 | Kilgore | |
| 5,318,131 | A | 6/1994 | Baker | |
| 5,697,449 | A | 12/1997 | Hennig et al. | |

(Continued)

FOREIGN PATENT DOCUMENTS

| | | | |
|---|---|---|---|
| CN | 1759227 | A | 4/2006 |
| CN | 200943455 | Y | 9/2007 |

(Continued)

OTHER PUBLICATIONS

Office Action issued Mar. 28, 2011, for U.S. Appl. No. 11/737,868, 16 pages.

(Continued)

*Primary Examiner* — Caroline Butcher
(74) *Attorney, Agent, or Firm* — Locke Lord LLP

(57) ABSTRACT

A method of forming an entry guide at an end of a tubular string in a wellbore can include conveying a forming device into the wellbore, and deforming the end of the tubular string from a cylindrical shape to an outwardly widening shape with the forming device. A method of forming an entry guide at an end of an expanded liner hanger in a wellbore can include outwardly expanding the liner hanger, thereby sealingly securing a tubular string in the wellbore, and deforming the end of the liner hanger from a cylindrical shape to an outwardly widening shape with a forming device.

24 Claims, 7 Drawing Sheets

(56) References Cited

U.S. PATENT DOCUMENTS

| | | | | |
|---|---|---|---|---|
| 6,012,523 | A | 1/2000 | Campbell et al. | |
| 6,053,262 | A | 4/2000 | Ferguson et al. | |
| 6,138,761 | A * | 10/2000 | Freeman et al. | 166/313 |
| 6,241,018 | B1 | 6/2001 | Eriksen | |
| 6,446,724 | B2 | 9/2002 | Baugh et al. | |
| 6,467,547 | B2 | 10/2002 | Maguire et al. | |
| 6,631,765 | B2 * | 10/2003 | Baugh et al. | 166/285 |
| 6,648,075 | B2 | 11/2003 | Badrak et al. | |
| 6,817,421 | B2 | 11/2004 | Dallas | |
| 6,854,521 | B2 | 2/2005 | Echols et al. | |
| 6,910,537 | B2 * | 6/2005 | Brown et al. | 166/294 |
| 6,915,852 | B2 | 7/2005 | Baugh et al. | |
| 7,011,162 | B2 | 3/2006 | Maguire | |
| 7,048,065 | B2 | 5/2006 | Badrak et al. | |
| 7,077,211 | B2 | 7/2006 | Cook et al. | |
| 7,090,005 | B2 | 8/2006 | Smith, Jr. et al. | |
| 7,090,006 | B2 * | 8/2006 | Salama | 166/208 |
| 7,124,829 | B2 | 10/2006 | Braddick | |
| 7,128,147 | B2 | 10/2006 | Marcin et al. | |
| 7,152,684 | B2 | 12/2006 | Harrall et al. | |
| 7,156,179 | B2 | 1/2007 | Harrall et al. | |
| 7,156,182 | B2 | 1/2007 | Lynde et al. | |
| 7,159,666 | B2 | 1/2007 | Nobileau | |
| 7,172,027 | B2 | 2/2007 | Simpson et al. | |
| 7,185,701 | B2 | 3/2007 | Mackenzie | |
| 7,216,701 | B2 | 5/2007 | Cook et al. | |
| 7,225,879 | B2 | 6/2007 | Wylie et al. | |
| 7,225,880 | B2 | 6/2007 | Braddick | |
| 7,240,729 | B2 | 7/2007 | Cook et al. | |
| 7,278,492 | B2 | 10/2007 | Braddick | |
| 7,290,605 | B2 * | 11/2007 | Waddell et al. | 166/207 |
| 7,350,563 | B2 | 4/2008 | Waddell et al. | |
| 7,441,606 | B2 | 10/2008 | Maguire | |
| 7,543,637 | B2 | 6/2009 | Green et al. | |
| 7,543,639 | B2 * | 6/2009 | Emerson | 166/277 |
| 7,591,315 | B2 * | 9/2009 | Dore et al. | 166/338 |
| 2002/0070032 | A1 | 6/2002 | Maguire et al. | |
| 2003/0150614 | A1 * | 8/2003 | Brown et al. | 166/286 |
| 2003/0155159 | A1 | 8/2003 | Slack et al. | |
| 2003/0230410 | A1 | 12/2003 | Underhill | |
| 2004/0173361 | A1 | 9/2004 | Lohbeck | |
| 2004/0182582 | A1 * | 9/2004 | Bosma et al. | 166/387 |
| 2004/0246112 | A1 | 12/2004 | Strumolo et al. | |
| 2004/0256112 | A1 | 12/2004 | Harrall et al. | |
| 2005/0121202 | A1 * | 6/2005 | Abercrombie Simpson et al. | 166/380 |
| 2005/0145417 | A1 | 7/2005 | Radford et al. | |
| 2005/0241834 | A1 * | 11/2005 | McGlothen et al. | 166/380 |
| 2005/0263292 | A1 | 12/2005 | Braddick | |
| 2005/0279514 | A1 | 12/2005 | Metcalfe | |
| 2006/0196656 | A1 | 9/2006 | McGlothen et al. | |
| 2006/0272807 | A1 | 12/2006 | Adam et al. | |
| 2007/0000664 | A1 | 1/2007 | Ring et al. | |
| 2007/0029095 | A1 | 2/2007 | Brisco et al. | |
| 2007/0187113 | A1 | 8/2007 | Hester | |
| 2008/0202753 | A1 * | 8/2008 | Harrall et al. | 166/297 |
| 2008/0257560 | A1 | 10/2008 | Brisco | |
| 2009/0107686 | A1 | 4/2009 | Watson | |
| 2011/0011320 | A1 | 1/2011 | Yemington | |
| 2011/0048699 | A1 * | 3/2011 | Wubben et al. | 166/207 |
| 2012/0125635 | A1 | 5/2012 | Watson et al. | |
| 2013/0233554 | A1 * | 9/2013 | Myers et al. | 166/297 |

FOREIGN PATENT DOCUMENTS

| | | | |
|---|---|---|---|
| GB | 2389865 | A | 12/2003 |
| WO | WO-2012/071208 | A2 | 5/2012 |

OTHER PUBLICATIONS

Office Action issued May 7, 2013 for U.S. Appl. No. 13/053,896, 8 pages.
Office Action issued Aug. 19, 2011 for U.S. Appl. No. 13/053,896, 18 pages.
Canadian Office Action issued Apr. 2, 2012 for CA Patent Application No. 2,684,547, 2 pages.
Office Action issued Jun. 2, 2012 for U.S. Appl. No. 13/053,896, 12 pages.
International Search Report with Written Opinion issued Jun. 29, 2012 for PCT Patent Application No. PCT/US11/060617, 11 pages.
Office Action issued Jun. 18, 2012 for U.S. Appl. No. 11/737,868, 17 pages.
Office Action issued Nov. 30, 2011 for U.S. Appl. No. 13/053,896, 16 pages.
U.S. Appl. No. 11/923,374, filed Oct. 24, 2007, 36 pages.
International Search Report and Written Opinion issued Feb. 13, 2009, for International Patent Application Serial No. PCT/US08/80423, 9 pages.
International Search Report and Written Opinion issued Aug. 21, 2008, for International Patent Application Serial No. PCT/US08/60106, 7 pages.
Office Action issued Oct. 7, 2008, for U.S. Appl. No. 11/737,868, 24 pages.
Halliburton Completion Tools, Versaflex® Stimulation Acid Washdown (SAW) System, Apr. 2007, 2 pages.
Halliburton Versaflex® Expandable Liner System, Nov. 2006,14 pages.
Halliburton Versaflex® Liner Hanger System, May 21, 2007, 1 page.
Halliburton Versaflex Product Brochure, Nov. 2006, 2 pages.
Halliburton Drawing No. 59VRT7096400, Setting Tool Assembly, Dec. 22, 2006, 9 pages.
Office Action issued Apr. 2, 2009, for U.S. Appl. No. 11/737,868, 15 pages.
Final Office Action issued Oct. 28, 2009, for U.S. Appl. No. 11/737,868, 14 pages.
Office Action issued Jan. 8, 2010, for U.S. Appl. No. 11/923,374, 24 pages.
Office Action issued Mar. 11, 2010, for U.S. Appl. No. 11/737,868, 14 pages.
Partial International Search Report issued for International Patent Application No. PCT/US2009/068008 dated Mar. 16, 2010, 7 pages.
Office Action issued May 12, 2010, for U.S. Appl. No. 11/923,374, 15 pages.
International Preliminary Report on Patentability issued May 6, 2010, for International Patent Application No. PCT/US08/80423, 7 pages.
International Search Report and Written Opinion issued May 31, 2010, for International Patent Application No. PCT/US09/068008, 19 pages.
Office Action issued Aug. 31, 2010, for U.S. Appl. No. 11/923,374, 11 pages.
Office Action issued Oct. 15, 2010, for U.S. Appl. No. 11/737,868, 23 pages.
Office Action issued Dec. 9, 2010, for U.S. Appl. No. 12/342,718, 30 pages.
Office Action issued Jun. 17, 2011 for U.S. Appl. No. 12/342,718, 9 pages.
Office Action issued Feb. 27, 2013 for U.S. Appl. No. 13/053,896, 11 pages.
Office Action issued Oct. 19, 2011, for U.S. Appl. No. 11/737,868, 19 pages.
International Preliminary Report on Patentability issued Oct. 29, 2009, for International Patent Application No. PCT/US08/060106, 7 pages.
Halliburton, "Versaflex Stimulation Acid Washdown (SAW) System," H05462 dated Jan. 2011, 2 pages.
Halliburton, "Versaflex Expandable Liner System," H06918, Jun. 2009, 2 pages.
Halliburton, "Versaflex Liner Hanger System," product presentation, dated 2011, 53 pages.
Halliburton, Versaflex brochure, H05234, dated Nov. 2006, 2 pages.
Halliburton drawing No. 59VRT7096400, "Setting Tool Assembly," dated Dec. 22, 2006.
International Search Report issued Aug. 21, 2008, for International Patent Application No. PCT/US08/60106, 2 pages.

(56) References Cited

OTHER PUBLICATIONS

Written Opinion issued Aug. 21, 2008, for International Patent Application No. PCT/US08/60106, 4 pages.
International Search Report and Written Opinion issued Feb. 13, 2009, for International Patent Application No. PCT/US08/80423, 9 pages.
Office Action issued Oct. 28, 2009, for U.S. Appl. No. 11/737,868, 14 pages.
Annex to Form PCT/ISA/206 from the International Searching Authority issued Mar. 16, 2010, for International Patent Application No. PCT/US09/068008, 7 pages.
Office Action issued Dec. 9, 2010 for U.S. Appl. No. 12/342,718, 30 pages.
Office Action issued Feb. 25, 2014 for Canadian Application Serial No. 2,815,558, 2 pages.
Chinese Office Action and English translation thereof, dated Dec. 8, 2015, issued on corresponding Chinese Patent Application No. 201180056248.4.
Australian Patent Examination Report No. 1 issued Apr. 22, 2015, on corresponding Australian Patent Application No. 2011332151, 4 pages.
Canadian Intellectual Property Office Examiner's Letter dated Dec. 30, 2014, issued on corresponding Canadian Patent Application No. 2,815,558, 4 pages.
Colombian Office Action, and English translation thereof, dated Jun. 16, 2014, issued on corresponding Patent Application No. 13-148189-2, 20 pages.
Chinese Office Action and English translation thereof dated Apr. 3, 2015, issued on corresponding Chinese Patent Application No. 201180056248.4, 14 pages.
Chinese Search Report dated Mar. 19, 2015 issued on Chinese Patent Application No. 201180056248.4 , 2 pages.
Indonesian Office Action dated Mar. 30, 2016, issued in Indonesian Patent Application No. W-00201302712, 2 pages.
Chinese Office Action dated Jun. 1, 2016, issued during the prosecution of corresponding Chinese Patent Application No. 201180056248.4, and English translation thereof (8 pages).

* cited by examiner

ENTRY GUIDE FORMATION ON A WELL LINER HANGER

BACKGROUND

This disclosure relates generally to equipment utilized and operations performed in conjunction with a subterranean well and, in an example described below, more particularly provides for entry guide formation on a well liner hanger.

For a variety of reasons, an end of a tubular string which is to be entered by another tubular string, equipment, wireline tools, etc., may not be satisfactorily configured for such entry. For example the end of the tubular string could be cut off, or a liner hanger could be connected in the tubular string, with the liner hanger lacking an entry guide, etc.

It will, therefore, be appreciated that it would be beneficial to be able to form an entry guide at an end of a tubular string.

SUMMARY

In the disclosure below, a forming device and a method are provided which bring improvements to the art of tubular string entry in a wellbore. One example is described below in which the forming device is biased into contact with the tubular string by work string weight. Another example is described below in which pressure differentials are used to anchor the forming device, displace deforming structures, and then release the forming device from the tubular string.

In one aspect, a method of forming an entry guide at an end of a tubular string in a wellbore is provided by the disclosure below. The method can include conveying a forming device into the wellbore, and deforming the end of the tubular string from a cylindrical shape to an outwardly widening shape with the forming device.

In another aspect, the disclosure provides a method of forming an entry guide at an end of an expanded liner hanger in a wellbore. The method can include outwardly expanding the liner hanger, thereby sealingly securing a tubular string in the wellbore, and deforming the end of the liner hanger from a cylindrical shape to an outwardly widening shape with a forming device.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
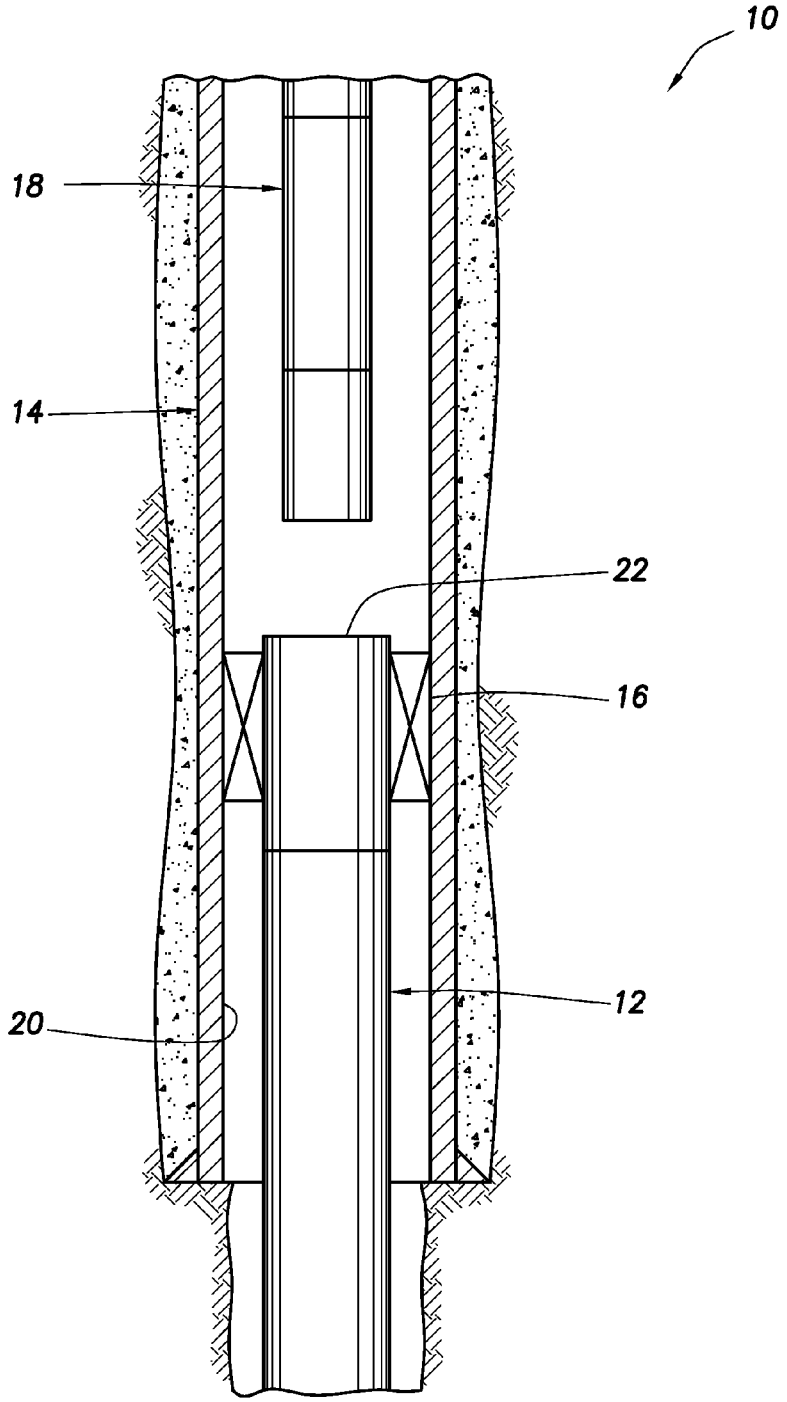
FIG. 1 is a schematic partially cross-sectional view of a well system and associated method which can embody principles of the present disclosure.

Representatively illustrated in FIG. 1 is a well system 10 and associated method which can embody principles of this disclosure. In the system 10, a tubular string 12 (such as a liner string) in a wellbore 20 is sealingly secured in another tubular string 14 (such as a casing string) by a liner hanger 16 interconnected at an upper end 22 of the tubular string 12.

After the liner hanger 16 is set, it is desired to convey yet another tubular string 18 (such as a completion string, perforating string, etc.) into the tubular string 12. However, the upper end 22 of the liner hanger 16 has a cylindrical shape and is smaller than the wellbore 20 so that, unless the tubular string 18 is axially aligned with the liner hanger, difficulty will be encountered in displacing the tubular string 18 into the liner hanger.

In some cases, the upper end 22 of the liner hanger 16 cannot be initially provided with an entry guide, because the liner hanger and its setting tool (not shown) must be conveyed through a restricted bore uphole. For example, when relatively large casing is used, a casing hanger in a wellhead can have an inner diameter which is smaller than an inner diameter of the casing. Thus, the liner hanger 16 and its setting tool must pass through the restricted bore of the casing hanger, and then the liner hanger must be set in the larger inner diameter of the casing.

One way to set the liner hanger 16 is to expand it radially outward into sealing and gripping contact with the tubular string 14. Various expandable liner hangers and setting tools therefor are known in the art, one of which is described in U.S. patent application Ser. No. 12/342,718 filed 23 Dec. 2008, the entire disclosure of which is incorporated herein by this reference.

In the system 10 of FIG. 1, the upper end 22 of the tubular string 12 can be swaged or otherwise deformed outward to form an entry guide. This will allow the tubular string 18 or any other equipment (such as, wireline tools, coiled tubing, etc.) to easily pass into the tubular string 12.

Figure 2:
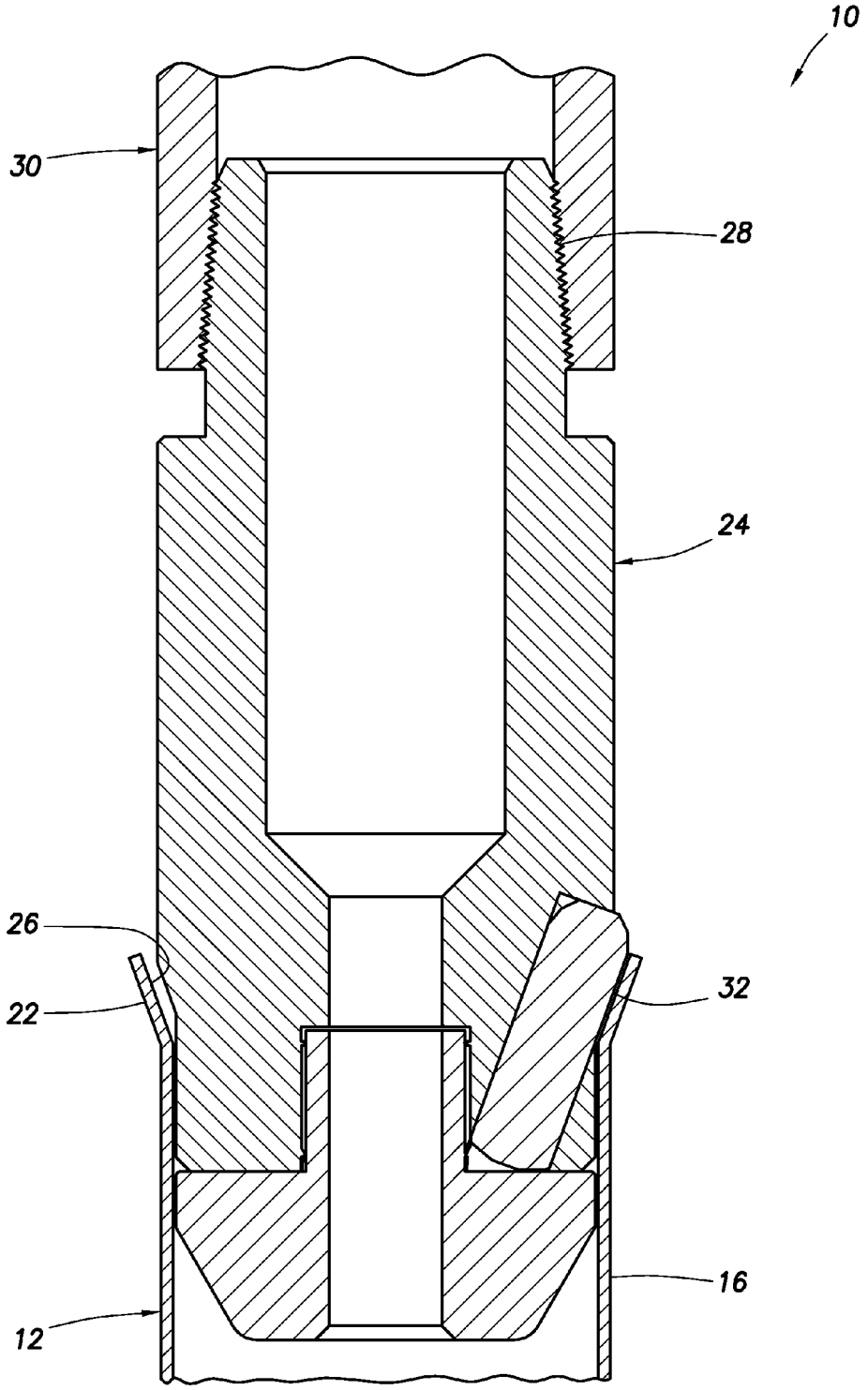
FIG. 2 is a schematic cross-sectional view of a forming device which may be used in the system and method of FIG. 1.

Referring additionally now to FIG. 2, an enlarged scale cross-sectional view of one example of a forming device 24 which may be used to form an entry guide 26 at the end 22 of the tubular string 12 is representatively illustrated. The forming device 24 is provided with a connector 28 at an upper end thereof for connection to a tubular work string 30 used to convey the forming device into the wellbore 20. The forming device 24 may be used in the system 10 and associated method, or it may be used in any other system and method.

A reduced diameter lower end of the forming device 24 is inserted into the upper end 22 of the tubular string 12, and then the forming device is rotated and lowered by the work string 30, until deforming structures 32 (such as inclined rollers, only one of which is visible in FIG. 2) form the outwardly widening entry guide 26. The deforming structures 32 outwardly deform the upper end 22, so that the entry guide 26 has a frusto-conical shape, although other outwardly widening shapes can be formed, if desired.

A biasing force is supplied by a weight of the work string 30 being applied via the forming device 24 to the upper end 22 as the deforming structures 32 roll about an inner diameter of the upper end. This forms the outwardly widening entry guide 26 in the upper end 22. The work string 30 with the forming device 24 can then be retrieved from the wellbore 20, and the tubular string 18 can be conveniently guided into the upper end 22 by the entry guide 26.

Figure 3A:
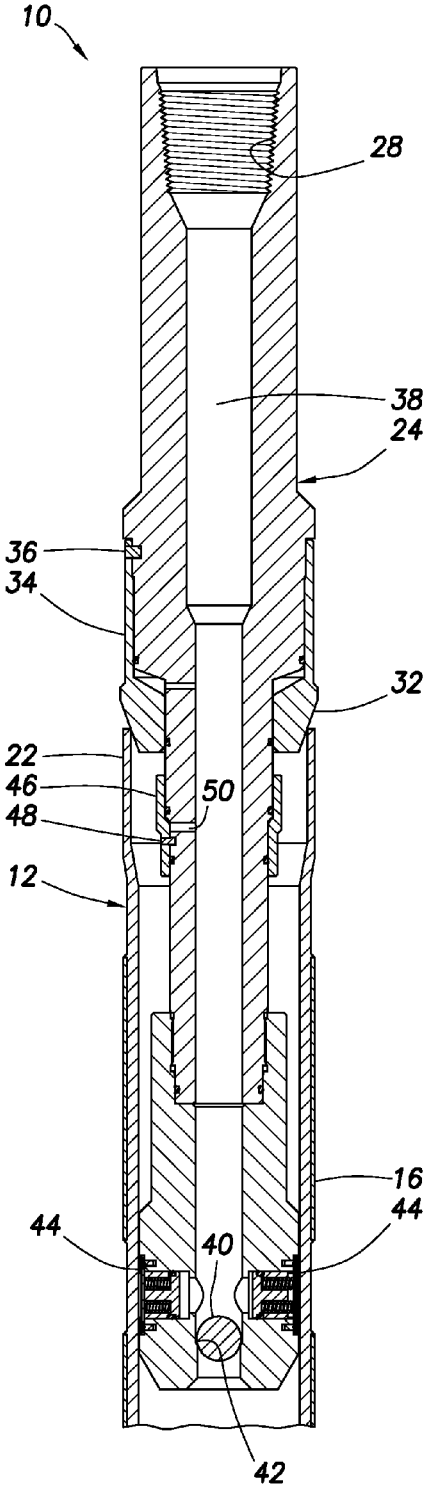
FIGS. 3A & B are schematic cross-sectional views of another configuration of the forming device prior to and after forming an entry guide at an end of the tubular string.

Referring additionally now to FIGS. 3A & B, another configuration of the forming device 24 as used in the system 10 is representatively illustrated. Preferably, the work string 30 would be connected to the connection 28 and would be used to convey the forming device 24 into the wellbore 20, and to transmit pressure to the forming device.

In FIG. 3A, a lower end of the forming device 24 has been inserted into the tubular string 12. A deforming structure 32 contacts the upper end 22 of the tubular string 12. In this example, the deforming structure 32 has a frusto-conical shape and is positioned on a lower end of a piston 34, but other shapes and arrangements of the structure and piston may be used, if desired.

A shear screw 36 maintains the piston 34 in its upper position as depicted in FIG. 3A, until a sufficient pressure differential is applied across the piston to shear the shear screw. The piston 34 is exposed on one side to pressure in an interior flow passage 38 of the forming device 24, and is exposed on an opposite side to pressure external to the forming device (e.g., in the wellbore 20 external to the forming device).

When it is desired to form the entry guide 26, a plug 40 is dropped and/or pumped through the work string 30 and flow passage 38, until it sealingly engages a seat 42. With the flow passage 38 blocked by the plug 40, increased pressure can be applied via the work string 30 to the passage 38, thereby applying a pressure differential between the flow passage and the exterior of the forming device 24.

The pressure differential displaces a set of anchoring devices 44 (such as slips of the type used on packers) outward into gripping engagement with the tubular string 12. This anchors the forming device 24 to the tubular string 12 for as long as the pressure differential is maintained. The pressure differential can then be increased, until it is sufficiently great to shear the shear screw 36. This releases the piston 34 and deforming structure 32 for downward displacement (as viewed in FIG. 3A) toward the upper end 22.

Figure 3B:
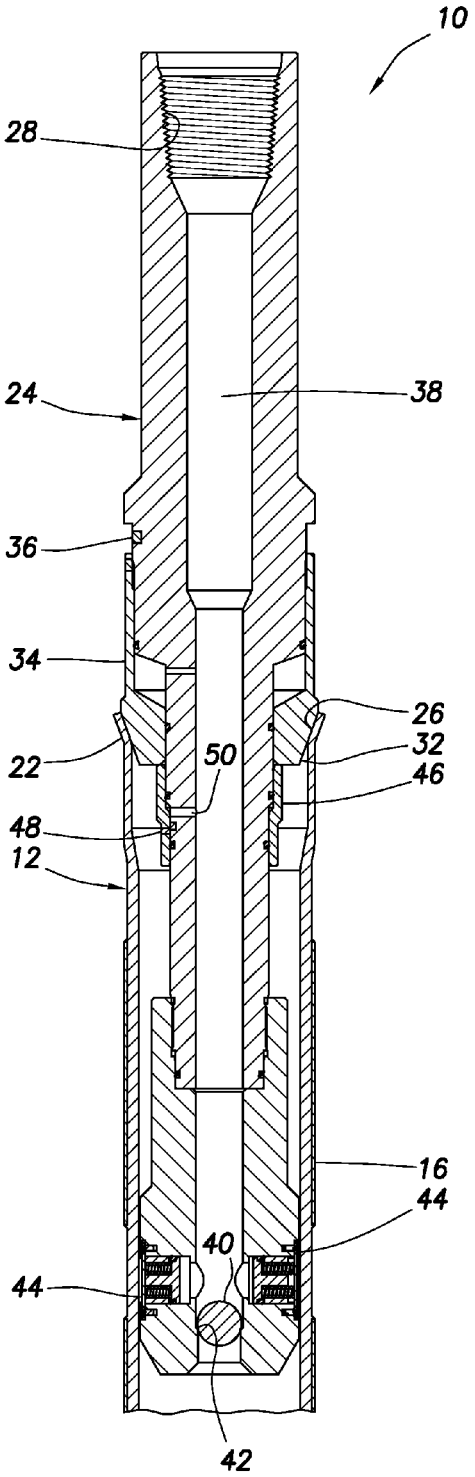

In FIG. 3B, the forming device 24 is depicted after the pressure differential has biased the piston 34 and deforming structure 32 downward (as viewed in FIG. 3B) into the upper end 22, thereby forming the entry guide 26. Additional pistons may be provided, if needed to generate sufficient biasing force to fully form the entry guide 26. At the end of its displacement, the piston 34 and deforming structure 32 contact a sleeve 46 and shear another shear screw 48 which initially retains the sleeve.

With the shear screw 48 sheared, the differential pressure will displace the sleeve 46 downward a sufficient distance to uncover a port 50, which allows the work string 30 to drain as it is retrieved with the forming device 24 from the wellbore 20. Opening of the port 50 also bleeds off the pressure differential, allowing the anchoring devices 44 to retract out of engagement with the tubular string 12, so that the forming device 24 can be withdrawn from the tubular string.

Figure 4A:
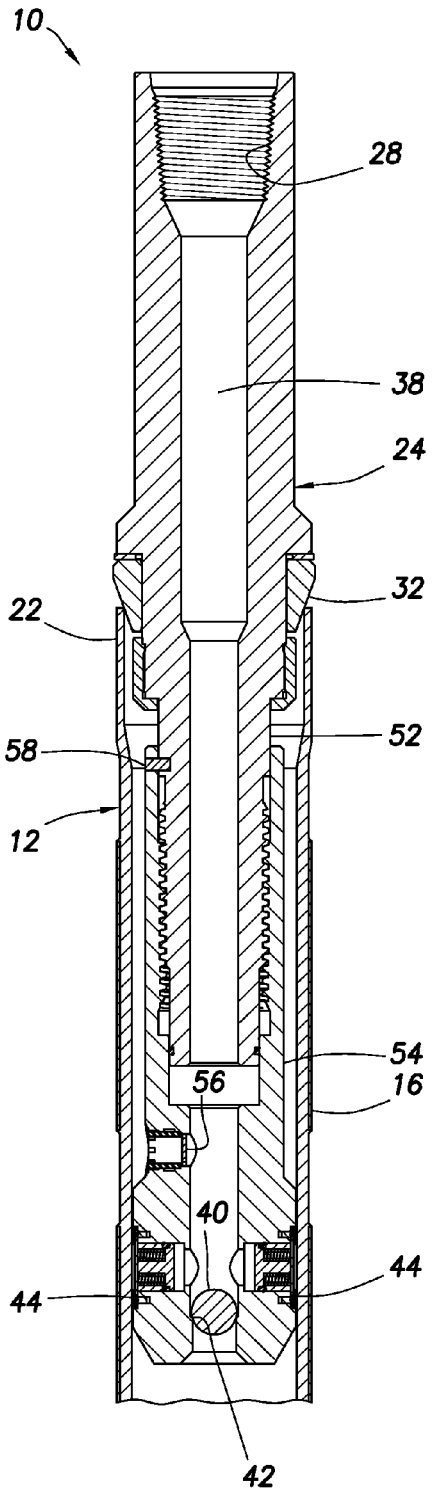
FIGS. 4A & B are schematic cross-sectional views of yet another configuration of the forming device prior to and after forming an entry guide at an end of the tubular string.

Referring additionally now to FIGS. 4A & B, another configuration of the forming device 24 is representatively illustrated. This configuration is similar in many respects to the configuration of FIGS. 3A & B, but differs in at least one respect, in that the deforming structure 32 is not displaced toward the upper end 22 by the piston 34, but is instead displaced downward (as viewed in FIGS. 4A & B) by threading together sections 52, 54 of the forming device 24. The sections 52, 54 are initially secured relative to each other by a shear screw 58.

In FIG. 4A, the forming device 24 has been conveyed into the tubular string 12 (for example, on the work string 30 connected to the connector 28), until the deforming structure 32 is in contact with the upper end 22. The plug 40 has been dropped and/or circulated into sealing engagement with the seat 42, and a pressure differential has been applied from the passage 38 to the exterior of the forming device 24 (for example, by increasing pressure in the work string 30). The pressure differential causes the anchoring devices 44 to grippingly engage the tubular string 12.

Figure 4B:
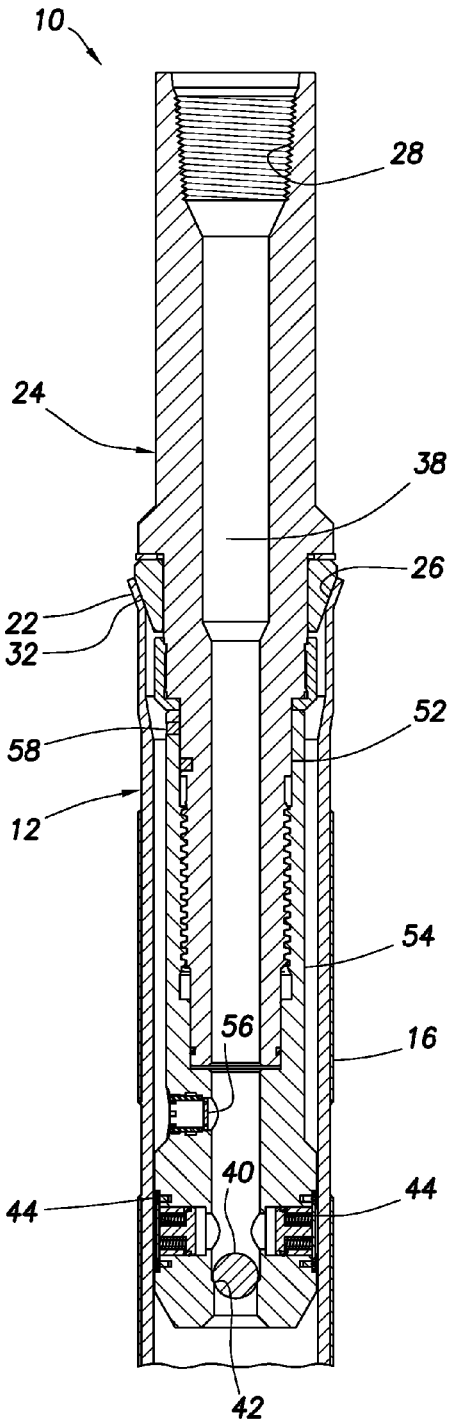

In FIG. 4B, the pressure differential is maintained, and the work string 30 is rotated, thereby rotating the upper section 52 of the forming device 24, shearing the shear screw 58, and threading the upper and lower sections 52, 54 together. This displaces the upper section 52 downward (as viewed in FIG. 4B), biasing the deforming structure 32 into the upper end 22, thereby forming the outwardly widened entry guide 26. A differential power screw may be used to increase the biasing force, or to decrease the torque needed to form the entry guide 26, if desired.

When the entry guide 26 has been formed, increased torque will be detected in the work string 30 (due to the sections 52, 54 being fully threaded together). Rotation of the work string 30 is ceased, and increased pressure is applied to the work string to break open a rupture disc 56. Opening of the rupture disc 56 relieves the pressure differential, thereby causing the anchoring devices 44 to retract, and allows the work string 30 to drain as it is retrieved from the wellbore 20.

In the configurations of FIGS. 3A-4B, the anchoring devices 44 could be replaced by keys, collets, lugs or dogs which engage a profile or recess formed in the interior of the tubular string 12 (for example, in the liner hanger 16). This may be the same profile or recess which is used to secure a setting tool for setting the liner hanger 16 (for example, a setting tool which outwardly expands the liner hanger into sealing and gripping engagement with the tubular string 14).

Figure 5A:
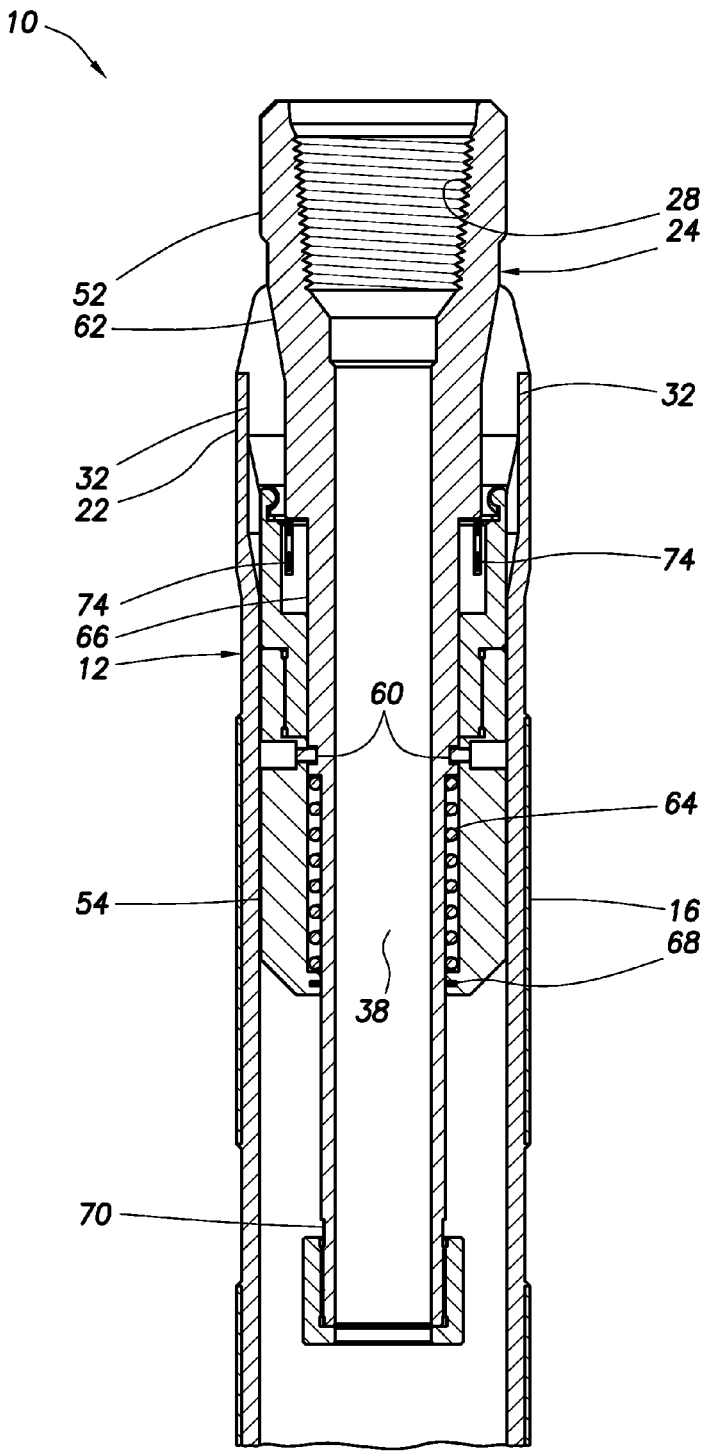
FIGS. 5A-C are schematic cross-sectional views of another configuration of the forming device prior to and after forming an entry guide at an end of the tubular string.
Figure 5B:
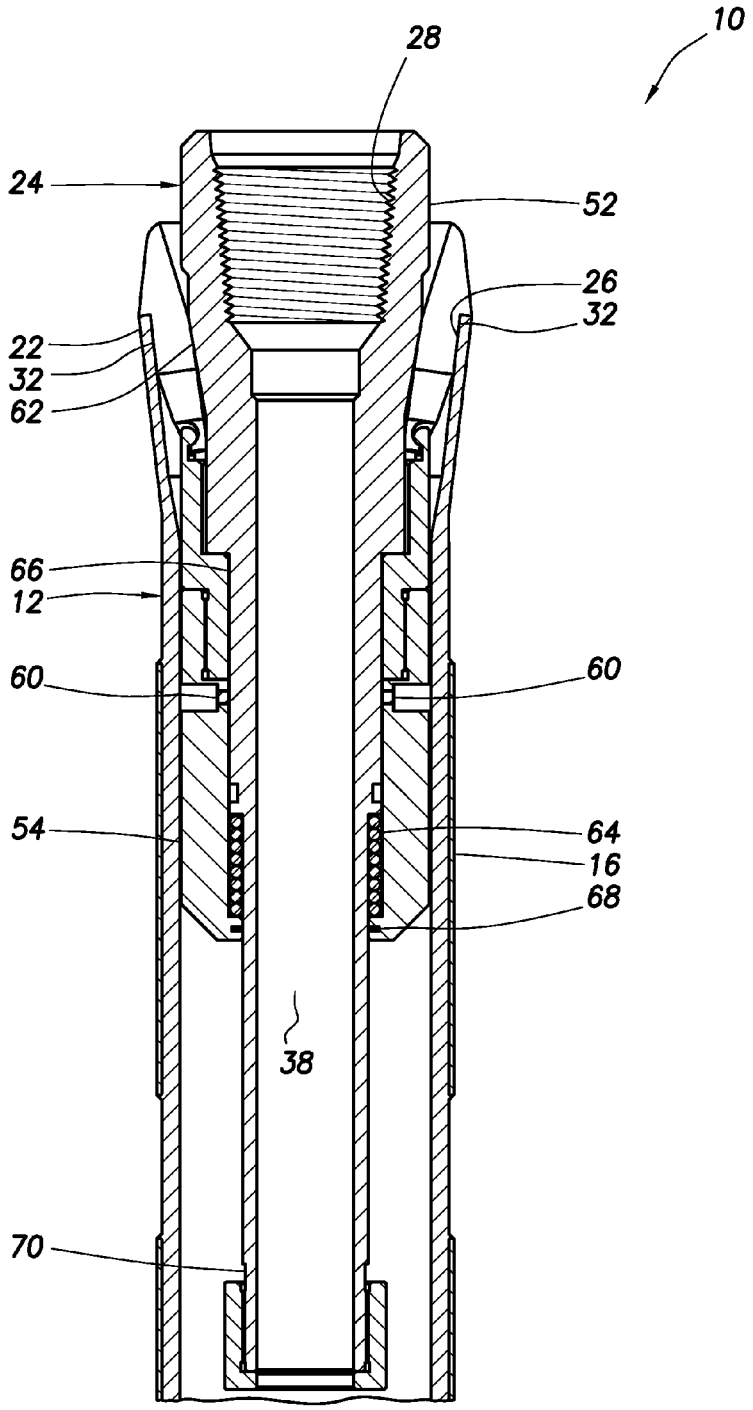
Figure 5C:
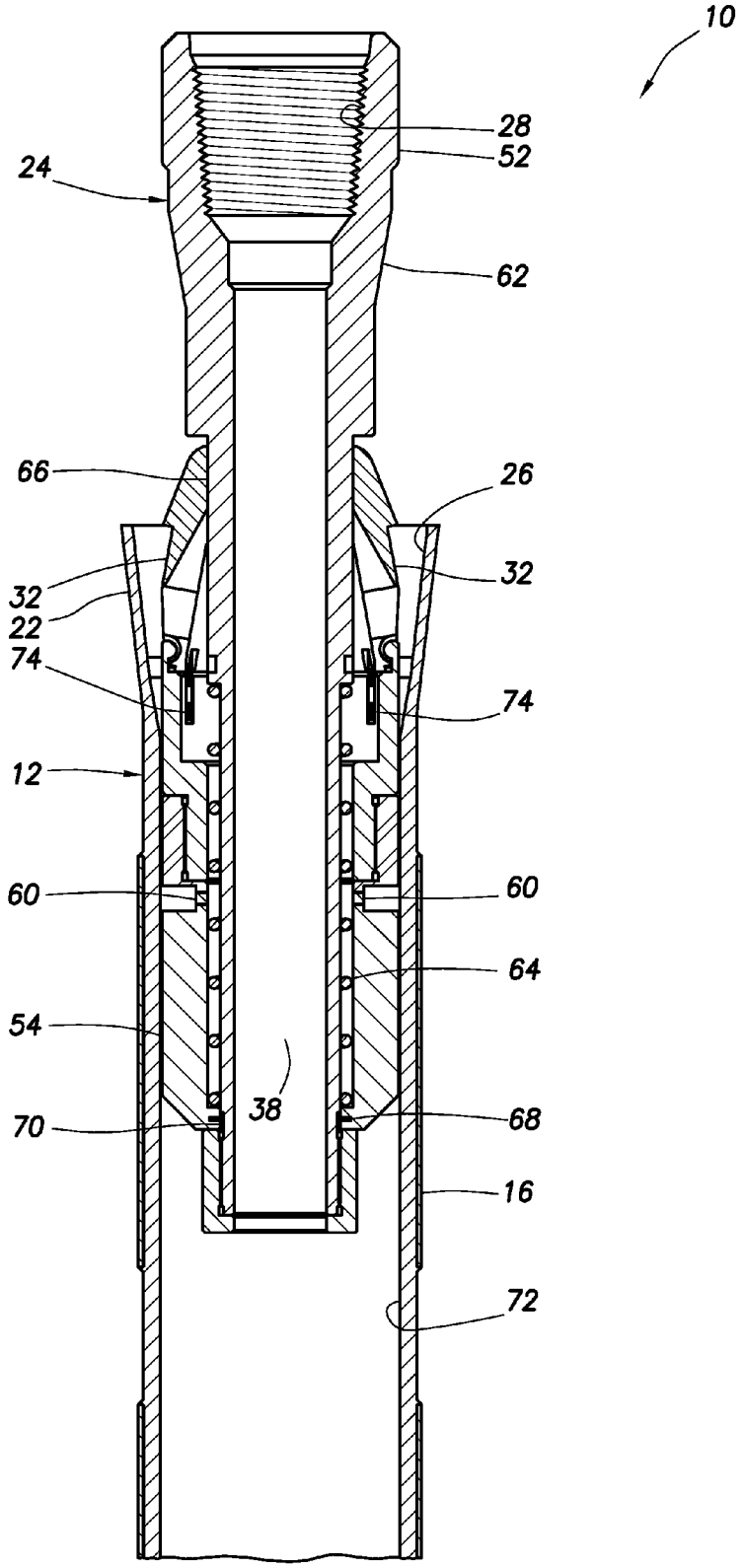

Referring additionally now to FIGS. 5A-C another configuration of the forming device 24 is representatively illustrated. In this configuration, the weight of the work string 30 (for example, connected to the connector 28) is used to outwardly pivot multiple deforming structures 32 to thereby form the entry guide 26 in the upper end 22 of the tubular string 12.

In FIG. 5A, the forming device 24 has been conveyed by the work string 30 into the tubular string 12, until the deforming structures 32 shoulder up on the upper end 22 of the tubular string. Shear screws 60 initially prevent an inclined surface 62 on the upper section 52 of the forming device 24 from displacing relative to the deforming structures 32. The deforming structures 32 are inwardly retained by keys 74.

In FIG. 5B, sufficient weight has been transmitted from the work string 30 to the forming device 24 to shear the shear screws 60, thereby allowing the upper section 52 to displace downward (as viewed in FIG. 5B). The inclined surface 62 biases the deforming structures 32 to pivot outward, thereby forming the outwardly widened entry guide 26 in the upper end 22 of the tubular string 12.

In FIG. 5C, the work string 30 has been raised, thereby relieving the biasing force that pivoted the deforming structures 32 outward. A biasing device 64 (such as a spring, compressed gas chamber, etc.) has displaced the lower section 54 downward (as viewed in FIG. 5C), thereby allowing the deforming structures 32 to pivot inward to a radially reduced portion 66 of the upper section 52.

The structures 32 are now preferably retracted sufficiently far that the forming device 24 can be displaced through the tubular string 12 (i.e., the forming device is no wider than the inner diameter of the tubular string). A snap ring 68 engages a radially reduced recess 70 to prevent upward displacement of the lower section 54 relative to the upper section 52, thereby preventing the deforming structures 32 from being biased outward again. The deforming structures 32 could be inwardly retained by a garter spring, snap ring, or any other device.

One particular benefit of this configuration is that the forming device 24 can be displaced further into the tubular string 12 after the entry guide 26 has been formed. Thus, seals (not shown) could be interconnected in the string 30 above the forming device 24, and could be stabbed into a seal bore 72 of the tubular string 12 (more specifically, a seal bore of the liner hanger 16) after the entry guide 26 is formed. In this case, the work string 30 could be a production tubing string for producing fluid from a reservoir intersected by the wellbore 20, an injection string for injecting fluid into the reservoir, etc.

Note that any of the forming device 24 configurations described above could be incorporated into a liner hanger setting tool, so that the entry guide 26 is formed in conjunction with setting the liner hanger 16. This would eliminate any need to make separate trips into the wellbore 20 to set the liner hanger 16, and then to form the entry guide 26.

Although the above descriptions of the system 10, the forming device 24 configurations and the methods of using the forming device have been applied to creating the entry guide 26 at the upper end 22 of the tubular string 12 (specifically, the upper end of the liner hanger 16), it should be clearly understood that it is not necessary for the end 22 to be an upper end (e.g., it could be a lower end or a lateral end, etc.), or for the end 22 to be part of the liner hanger 16.

Any of the features of any of the forming device 24 configurations could be used with any of the other configurations, in keeping with the principles of this disclosure. For example, the rupture disc 56 of the FIGS. 4A & B configuration could be used instead of the port 50 and sleeve 46 of the FIGS. 3A & B configuration, etc. Thus, it should be clearly understood that the features of the various configurations are not mutually exclusive.

It may now be fully appreciated that the above disclosure provides several advancements to the art. The forming device 24 allows for convenient forming of the entry guide 26 in the end 22 of the tubular string 12, so that another tubular string, equipment, wireline tools, etc. can easily enter the end of the tubular string.

The above disclosure provides to the art a method of forming an entry guide 26 at an end 22 of a tubular string 12 in a wellbore 20. The method can include conveying a forming device 24 into the wellbore 20, and deforming the end 22 of the tubular string 12 from a cylindrical shape to an outwardly widening shape with the forming device 24.

The tubular string 12 can include a liner hanger 16, and the method can include expanding the liner hanger 16 radially outward in the wellbore 20 prior to the conveying step.

The outwardly widening shape may comprise a frustoconical shape.

The deforming step can include rolling at least one inclined roller of the forming device 24 within the end 22 of the tubular string 12. The deforming step may also include biasing the forming device 24 against the end 22 of the tubular string 12 by applying weight from a work string 30 to the forming device 24. The deforming step can include rotating the work string 30 connected to the forming device 24 to thereby roll the roller within the end 22 of the tubular string 12.

The deforming step may include applying a first pressure differential across a piston 34, thereby biasing a deforming structure 32 into the end 22 of the tubular string 12. The method can also include anchoring the forming device 24 relative to the tubular string 12 prior to biasing the deforming structure 32 into the end 22 of the tubular string 12. The anchoring step may include biasing an anchoring device 44 into engagement with the tubular string 12 in response to applying a second pressure differential to the anchoring device 44, the second pressure differential being less than the first pressure differential.

The deforming step can include threading together first and second sections 52, 54 of the forming device 24, thereby biasing a deforming structure 32 into the end 22 of the tubular string 12. The threading step may include rotating a work string 30 connected to the forming device 24.

The method can also include anchoring the forming device 24 relative to the tubular string 12 prior to biasing the deforming structure 32 into the end 22 of the tubular string 12. The anchoring step may include biasing an anchoring device 44 into engagement with the tubular string 12 in response to applying a pressure differential to the anchoring device 44.

The deforming step can include outwardly displacing a set of deforming structures 32, and the method can include a step of inwardly retracting the deforming structures 32. The method may include displacing the forming tool 24 through the tubular string 12 after the step of inwardly retracting the deforming structures 32.

Also provided by the above disclosure is a method of forming an entry guide 26 at an end 22 of an expanded liner hanger 16 in a wellbore 20. The method may include outwardly expanding the liner hanger 16, thereby sealingly securing a tubular string 12 in the wellbore 20, and deforming the end 22 of the liner hanger 16 from a cylindrical shape to an outwardly widening shape with a forming device 24.

The expanding step may be performed prior to the deforming step.

The deforming step can include rolling at least one inclined roller of the forming device 24 within the end 22 of the liner hanger 16.

The deforming step can include applying a pressure differential across a piston 34, thereby biasing a deforming structure 32 into the end 22 of the liner hanger 16.

The deforming step can include threading together sections 52, 54 of the forming device 24, thereby biasing a deforming structure 32 into the end 22 of the liner hanger 16.

The deforming step may include outwardly displacing a set of deforming structures 32, and the method can include the step of inwardly retracting the deforming structures 32.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of representative examples, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of forming an entry guide on a tubular string in a wellbore, the method comprising:

conveying a forming device into the wellbore, the forming device comprising a deforming structure, and wherein the wellbore comprises a tubular string having an end with a generally tubular share of a first inner diameter; and deforming the end of the tubular string in a radially outward direction with the deforming structure from the first inner diameter to an outwardly widening shape, the outwardly widening shape continually decreasing in diameter from a terminal end of the tubular string to a portion of the tubular string below the outwardly widening shape that retains the generally tubular shape, thereby forming the entry guide, wherein at least a portion of the deforming structure extends beyond the terminal end of the tubular string during the deforming.

2. The method of claim 1, wherein the tubular string includes a liner hanger, and further comprising expanding the liner hanger radially outward in the wellbore prior to the conveying.

3. The method of claim 1, wherein the outwardly widening shape comprises a frusto-conical shape.

4. The method of claim 1, wherein the deforming further comprises rolling at least one inclined roller of the forming device within the end of the tubular string.

5. The method of claim 4, wherein the deforming further comprises biasing the forming device against the end of the tubular string by applying weight from a work string to the forming device.

6. The method of claim 4, wherein the deforming further comprises rotating a work string connected to the forming device to thereby roll the roller within the end of the tubular string.

7. The method of claim 1, wherein the deforming further comprises applying a first pressure differential across a piston, thereby biasing the deforming structure into the end of the tubular string.

8. The method of claim 7, further comprising anchoring the forming device relative to the tubular string prior to biasing the deforming structure into the end of the tubular string.

9. The method of claim 8, wherein the anchoring further comprises biasing an anchoring device into engagement with the tubular string in response to applying a second pressure differential to the anchoring device, the second pressure differential being less than the first pressure differential.

10. The method of claim 1, wherein the deforming further comprises threading together first and second sections of the forming device, thereby biasing the deforming structure into the end of the tubular string.

11. The method of claim 10, wherein the threading further comprises rotating a work string connected to the forming device.

12. The method of claim 10, further comprising anchoring the forming device relative to the tubular string prior to biasing the deforming structure into the end of the tubular string.

13. The method of claim 12, wherein the anchoring further comprises biasing an anchoring device into engagement with the tubular string in response to applying a pressure differential to the anchoring device.

14. The method of claim 1, wherein the deforming further comprises outwardly displacing a set of deforming structures, and inwardly retracting the deforming structures.

15. The method of claim 14, further comprising displacing the forming tool through the tubular string after the inwardly retracting.

16. A method of forming an entry guide on a liner hanger positioned in a wellbore, the method comprising:

outwardly expanding the liner hanger, thereby sealingly securing a first tubular string in the wellbore, wherein the liner hanger includes an end with a generally tubular shape of a first inner diameter; and deforming downhole the end of the liner hanger in a radially outward direction from the first inner diameter to an outwardly widening shape, the outwardly widening shape continually decreasing in diameter from a terminal end of the liner hanger to a portion of the liner hanger below the outwardly widening shape that retains the generally tubular shape, thereby facilitating entry of a second tubular string into the first tubular string.

17. The method of claim 16, wherein the expanding is performed prior to the deforming.

18. The method of claim 16, wherein the deforming further comprises rolling at least one inclined roller of a forming device within the end of the liner hanger.

19. The method of claim 16, wherein the deforming further comprises applying a pressure differential across a piston, thereby biasing a deforming structure into the end of the liner hanger.

20. The method of claim 16, wherein the deforming further comprises threading together first and second sections of a forming device, thereby biasing a deforming structure into the end of the liner hanger.

21. The method of claim 16, wherein the deforming further comprises outwardly displacing a set of deforming structures, and further comprising inwardly retracting the deforming structures.

22. The method of claim 16, wherein the expanding and the deforming are performed during a single trip into the wellbore.

23. A method of forming an entry guide on a tubular string in a wellbore, the method comprising:

conveying a forming device into the wellbore, the forming device comprising a deforming structure, and wherein the wellbore comprises a tubular string having an end with a generally tubular share of a first inner diameter;

deforming the end of the tubular string in a radially outward direction from the first inner diameter to an outwardly widening shape with the deforming structure, wherein the outwardly widening shape continually decreases in diameter from a terminal end of the tubular string to a portion of the tubular string below the outwardly widening shape that retains the generally tubular shape, thereby forming the entry guide, wherein at least a portion of the deforming structure extends beyond the terminal end of the tubular string during the deforming; and removing the forming device from the wellbore.

24. The method of claim 23, further comprising inserting a second tubular string into the entry guide of the first tubular string after removing the forming device from the wellbore.

* * * * *